US006994099B2

(12) United States Patent
Goldwitz

(10) Patent No.: US 6,994,099 B2
(45) Date of Patent: Feb. 7, 2006

(54) SHELTER WITH TWIST TIGHT CANOPY AND METHOD FOR ASSEMBLING SAME

(75) Inventor: Brian L. Goldwitz, Orange, CT (US)

(73) Assignee: OPAC, LLC, Stamford, CT (US)

( * ) Notice: Subject to any disclaimer, the term of this patent is extended or adjusted under 35 U.S.C. 154(b) by 352 days.

(21) Appl. No.: 10/282,283

(22) Filed: Oct. 28, 2002

(65) Prior Publication Data

US 2003/0084934 A1 May 8, 2003

Related U.S. Application Data

(60) Provisional application No. 60/339,577, filed on Oct. 26, 2001.

(51) Int. Cl.
*E04H 15/64* (2006.01)

(52) U.S. Cl. ..... 135/122; 135/115; 135/119; 135/120.4; 135/905; 52/63; 52/83

(58) Field of Classification Search ..... 135/122–124, 135/115, 119, 120.4, 907, 905, 909; 52/23, 52/2.25, 63, 83
See application file for complete search history.

(56) References Cited

U.S. PATENT DOCUMENTS

| | | | | |
|---|---|---|---|---|
| 1,170,794 | A | 2/1916 | Barnes | |
| 1,251,926 | A | 1/1918 | Schlesinger | |
| 1,262,564 | A | 4/1918 | Reynolds | |
| 1,291,758 | A | 1/1919 | Buck | |
| 1,650,323 | A | 11/1927 | Byars | |
| 1,958,296 | A | 5/1934 | Crow | 135/4 |
| 2,022,211 | A | 11/1935 | Leffert | 135/7.1 |
| 2,044,659 | A | 6/1936 | Adams | 135/3 |
| 2,151,908 | A | 3/1939 | Gottlieb | 135/136 |
| 2,182,283 | A | 12/1939 | Curtis | 135/4 |
| 2,440,449 | A | 4/1948 | Raemer | 20/2 |
| 2,448,895 | A | 9/1948 | Lawrence | 135/1 |
| 2,493,749 | A | 1/1950 | Brown et al. | 135/1 |
| 2,513,729 | A | 7/1950 | Lemen | 135/4 |
| 2,523,195 | A | 9/1950 | Comber | 135/3 |
| 2,568,048 | A | 9/1951 | Arnold | |
| 2,640,999 | A | 6/1953 | Sheppard | 5/113 |
| 2,690,185 | A | 9/1954 | Pomykala | 135/3 |
| 2,730,259 | A | 1/1956 | Frick | 217/43 |
| 2,764,107 | A | 9/1956 | Niswonger et al. | 108/23 |
| 2,835,406 | A | 5/1958 | Dickerson | 206/65 |
| 2,837,153 | A | 6/1958 | Brown et al. | 160/371 |
| 2,856,941 | A | 10/1958 | O'Neal | |
| 2,860,772 | A | 11/1958 | Northington, Jr. et al. | 206/321 |

(Continued)

FOREIGN PATENT DOCUMENTS

| | | |
|---|---|---|
| GB | 2156195 | 10/1985 |

(Continued)

*Primary Examiner*—Winnie Yip
(74) *Attorney, Agent, or Firm*—Edwards Angell Palmer & Dodge, LLP; George N. Chaclas, Esq.

(57) ABSTRACT

A shelter having an internal frame comprised of a roof supported by legs. A canopy covers the roof of the frame to provide protection from the elements. The canopy is taughtly held onto the frame by cords which pass through sleeves in the front and back of the canopy and attach to the corner legs of the frame. To tension the canopy onto the frame, the corner legs are twisted to tension the cords and, in turn, the canopy. Upon tensioning the canopy, the corner legs are locked in the rotated position.

17 Claims, 11 Drawing Sheets

U.S. PATENT DOCUMENTS 2,865,386 A 12/1958 Burns ..... 135/1
2,905,281 A 9/1959 Zitomer ..... 189/34
2,908,121 A 10/1959 Enos, Jr. ..... 53/3
2,986,150 A 5/1961 Torian ..... 135/1
3,004,542 A 10/1961 Moody ..... 135/1
3,055,380 A 9/1962 Benka et al. ..... 135/1
3,082,739 A 3/1963 Schloemer
3,199,518 A 8/1965 Glidewell ..... 135/4
3,222,841 A 12/1965 Lipof ..... 52/731
3,332,551 A 7/1967 Peterson ..... 206/65
3,375,831 A 4/1968 Serbus ..... 135/1
3,424,178 A 1/1969 Yazaki
3,453,786 A 7/1969 Rebarchek ..... 52/63
3,541,994 A 11/1970 Meng et al.
3,550,559 A 12/1970 Long
3,631,548 A 1/1972 Dehab
3,708,199 A 1/1973 Throssell ..... 296/23
3,957,069 A 5/1976 Denaro ..... 135/15
3,973,280 A 8/1976 Mathou
4,051,638 A 10/1977 Heintz ..... 52/63
4,070,846 A 1/1978 Sohlberg ..... 52/641
4,074,682 A 2/1978 Yoon ..... 135/4
4,090,472 A 5/1978 York
4,557,311 A 12/1985 Reining ..... 160/330
4,561,227 A 12/1985 Austin ..... 52/236
4,566,729 A 1/1986 Magnino ..... 296/259
4,607,656 A 8/1986 Carter ..... 135/145
4,630,627 A 12/1986 Windows et al. ..... 135/97
4,640,061 A 2/1987 Trumley ..... 52/71
4,641,676 A 2/1987 Lynch ..... 135/145
4,669,138 A 6/1987 Kassai
4,779,635 A 10/1988 Lynch ..... 135/97
4,787,603 A 11/1988 Norton
4,817,655 A 4/1989 Brooks ..... 135/121
4,894,888 A 1/1990 Bassouls
4,924,896 A 5/1990 Carter ..... 135/90
4,947,884 A 8/1990 Lynch
5,046,545 A 9/1991 Loomis et al.
5,058,863 A 10/1991 Maffet
5,063,876 A 11/1991 Harris
5,116,256 A 5/1992 Allen
5,117,853 A * 6/1992 Pruesner ..... 135/121
5,224,306 A 7/1993 Cramer ..... 52/63
5,244,001 A 9/1993 Lynch ..... 135/145
5,245,802 A 9/1993 Davis ..... 52/86
5,275,188 A 1/1994 Tsai ..... 135/97
5,299,849 A * 4/1994 Cook et al. ..... 296/100.15
5,450,889 A 9/1995 Jones et al. ..... 160/38
5,485,863 A 1/1996 Carter ..... 135/145
5,490,532 A 2/1996 Malloookis et al. ..... 135/117
5,490,533 A 2/1996 Carter ..... 135/145
5,509,713 A 4/1996 Hou ..... 296/138
5,511,572 A 4/1996 Carter ..... 135/145
5,520,236 A 5/1996 Thomas et al. ..... 160/120
5,522,184 A * 6/1996 Oviedo-Reyes ..... 52/23
5,555,681 A 9/1996 Cawthon ..... 52/63
5,564,367 A 10/1996 Boyanton
5,598,668 A 2/1997 Isom ..... 52/86
5,617,681 A 4/1997 Lyons ..... 52/82
5,632,292 A 5/1997 Carter ..... 135/145
5,632,293 A 5/1997 Carter ..... 135/145
5,634,483 A 6/1997 Gwin ..... 135/131
5,634,638 A 6/1997 Havens et al. ..... 473/421
5,638,853 A 6/1997 Tsai
5,655,340 A * 8/1997 Pelsue ..... 52/71
5,701,923 A 12/1997 Losi, Jr. et al. ..... 135/131
5,730,281 A 3/1998 Powell et al. ..... 206/223
D397,445 S 8/1998 Thorbeck et al. ..... D25/32
5,797,412 A 8/1998 Carter ..... 135/145
5,800,106 A 9/1998 Miller
5,802,647 A 9/1998 Helmsderfer ..... 5/947
5,819,474 A 10/1998 Strom ..... 52/4
5,845,423 A 12/1998 Hicks ..... 40/603
D409,310 S 5/1999 Goldwitz ..... D25/1
5,901,522 A 5/1999 Slater ..... 52/641
5,918,615 A 7/1999 Stuck, Sr. ..... 135/135
5,921,260 A 7/1999 Carter ..... 135/145
5,934,301 A 8/1999 Carter ..... 135/145
5,944,085 A 8/1999 Malott ..... 160/67
D414,564 S 9/1999 Goldwitz ..... D25/61
D415,571 S 10/1999 Goldwitz ..... D25/1
D415,572 S 10/1999 Goldwitz ..... D25/56
5,967,091 A 10/1999 Zartman
6,014,781 A 1/2000 Cone, II
6,021,742 A 2/2000 Cummings
6,062,243 A 5/2000 Tuch et al. ..... 135/124
6,070,604 A 6/2000 Carter ..... 135/145
6,076,312 A 6/2000 Carter ..... 52/145
D430,306 S 8/2000 Goldwitz ..... D25/61
6,098,217 A 8/2000 Hammil
6,129,102 A 10/2000 Carter ..... 135/145
6,141,902 A 11/2000 Boice ..... 47/17
6,155,280 A 12/2000 Powell et al. ..... 135/124
6,173,726 B1 1/2001 Talmadge ..... 135/144
6,247,484 B1 * 6/2001 Thomas ..... 135/123
6,286,268 B1 9/2001 Pena
6,305,672 B1 10/2001 Case et al.
6,318,297 B1 11/2001 Hatfield
6,367,495 B1 4/2002 Powell et al. ..... 135/122
6,367,496 B1 * 4/2002 Rempel et al. ..... 135/122
6,431,315 B1 8/2002 Lewis
6,481,784 B2 * 11/2002 Cargill ..... 296/159
6,505,638 B1 1/2003 Powell et al. ..... 135/124
6,568,350 B1 5/2003 Savard et al.
6,684,584 B1 2/2004 Goldwitz ..... 52/222
6,725,808 B2 4/2004 Campbell et al.
2001/0011392 A1 8/2001 Homeyer

FOREIGN PATENT DOCUMENTS

JP 10-18429 * 1/1998

* cited by examiner

SHELTER WITH TWIST TIGHT CANOPY AND METHOD FOR ASSEMBLING SAME

CROSS-REFERENCE TO RELATED APPLICATION

This application claims priority to U.S. Provisional Patent Application No. 60/339,577, filed Oct. 26, 2001, which is incorporated herein by reference.

BACKGROUND OF THE INVENTION

1. Field of the Invention

The present disclosure relates generally to a shelter and, more particularly, to a shelter including a frame with a canopy thereon. Even more particularly, the present disclosure relates to a shelter including a canopy mounted on the frame by stretchable cords and a twist tightening mechanism.

2. Background of the Related Art

Over the years, many shelters which provide protection from the elements have been introduced. Some common uses for such structures are to provide shelter during camping trips, picnics, and parties as well as store vehicles such as automobiles and boats. While conventional wooden or brick shelters provide the desired protection, such structures are generally quite expensive. In fact, it is often the case that construction of such a conventional garage structure costs as much or more than the vehicle that it is intended to protect.

As an alternative to such conventional garage and tent structures, relatively inexpensive and light-weight canopy-type structures are often employed. These canopy structures are typically comprised of a light-weight internal frame and an outer covering or canopy. In general, such canopy structures provide complete or full overhead protection and occasionally provide partial side wall protection. Such canopy-type structures provide some degree of protection from the sun and rain, however, they often perform poorly in windy conditions. That is, the outer covering is easily moved and flopped by the wind. In light wind conditions, such movement tends to reduce the overall aesthetic appearance and effectiveness of the canopy, as rain and sun are periodically allowed to pass unobstructed into the interior or protected region of the canopy. Furthermore, in high wind conditions, the movement of the canopy may actually lead to damage. Moreover, some prior shelter frames also allow the canopy to sag and form unsightly pockets where water can accumulate to: stress and tear the canopy; loosen the fit of the canopy making it insecure; reduce headroom; and ultimately produce an unsightly shelter.

Therefore there is and continues to be a need for an improved light-weight and relatively inexpensive protective canopy structure, that includes a covering which is securely tensioned to the supporting internal frame structure.

SUMMARY OF THE INVENTION

The present invention is directed to a shelter including a frame having opposing sides, a front, a back and a roof. A canopy covers the roof and includes two pockets formed along the front and back of the canopy. Cording, disposed in each of the pockets, has a fastener for securing each end of the cording to a respective corner leg of the frame such that when the corner legs of the frame are rotated, the canopy is tensioned onto the frame. A fastener is set in holes formed in the corner legs and roof to maintain the rotated position of the corner legs. As a result, a bungyless canopy shelter can be quickly, easily and cheaply constructed. Additionally, a plurality of bungee-ball cords can be disposed in grommets in the canopy to further secure the canopy to the sides of the frame.

The present invention is also directed to a method for making a shelter including the steps of assembling a frame having opposing sides, a front, a back and a roof, forming pockets along opposing edges of a canopy, disposing a cord in each of the pockets, covering the roof with the canopy, securing each end of the cords to a corner of the frame, twisting the corners of the frame to tension the canopy onto the frame, sashing the canopy to the sides of the frame and preventing unraveling of the twisting of the corners of the frame.

Accordingly, it is an object of the subject invention to provide an inexpensive and efficient method for effectively assembling a shelter with a canopy securely and aesthetically secured to a frame.

It is another object of the subject invention to provide a shelter which, upon tensioning a canopy onto a frame in the corners, results in a canopy taughtly held across the entire roof of the frame.

It is another object of the subject invention to provide a shelter which does not pucker or hang loosely in the corners.

It is another object of the subject invention to provide a shelter which does not require bungy attachments on the front or back.

It should be appreciated that the present invention can be implemented and utilized in numerous ways, including without limitation as a process, an apparatus, a system, a device and a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the drawings wherein.

DETAILED DESCRIPTION OF THE PREFERRED EMBODIMENT

Figure 1:
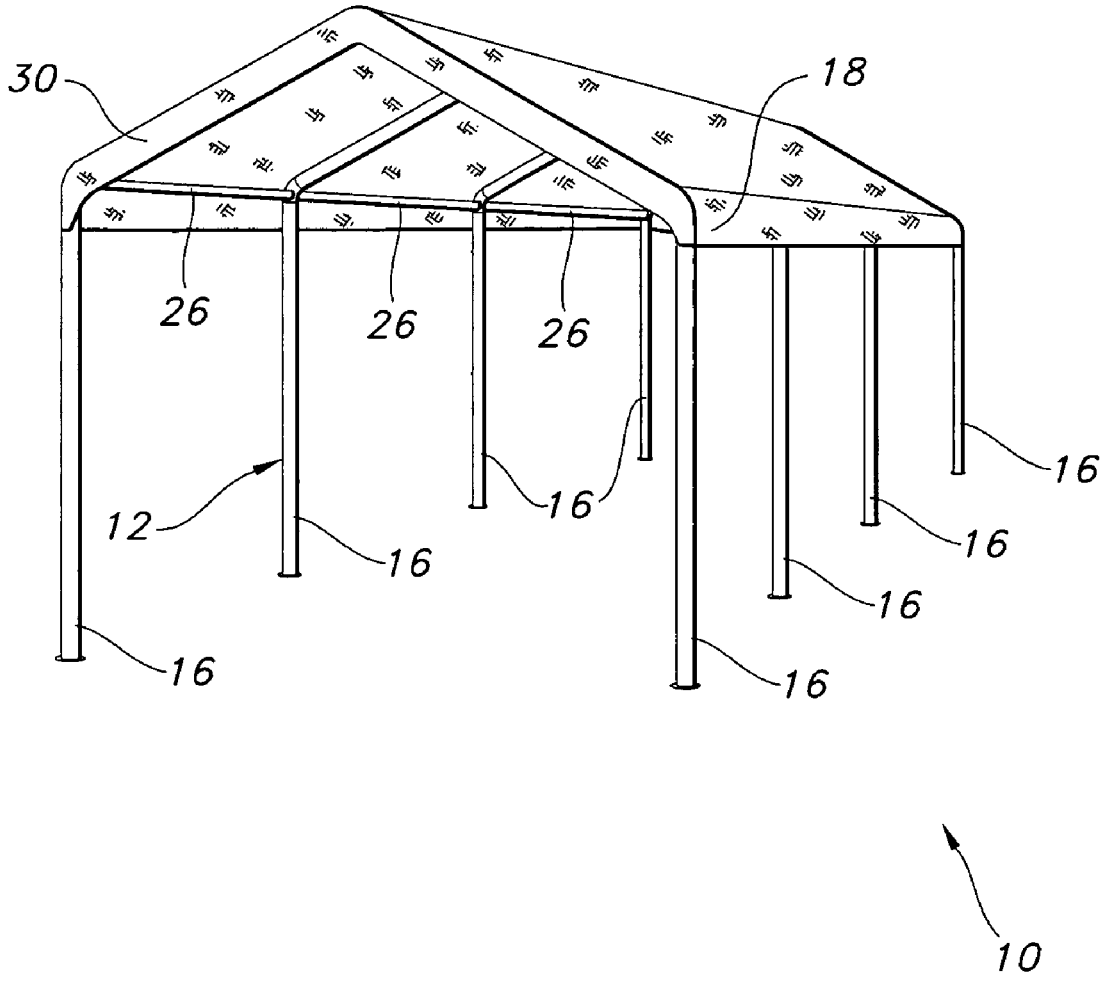
FIG. 1 is a perspective view of a shelter according to the present disclosure including a canopy mounted on a frame.

The present invention overcomes many of the prior art problems associated with shelters having a canopy. The advantages, and other features of the shelter disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

Figure 4:
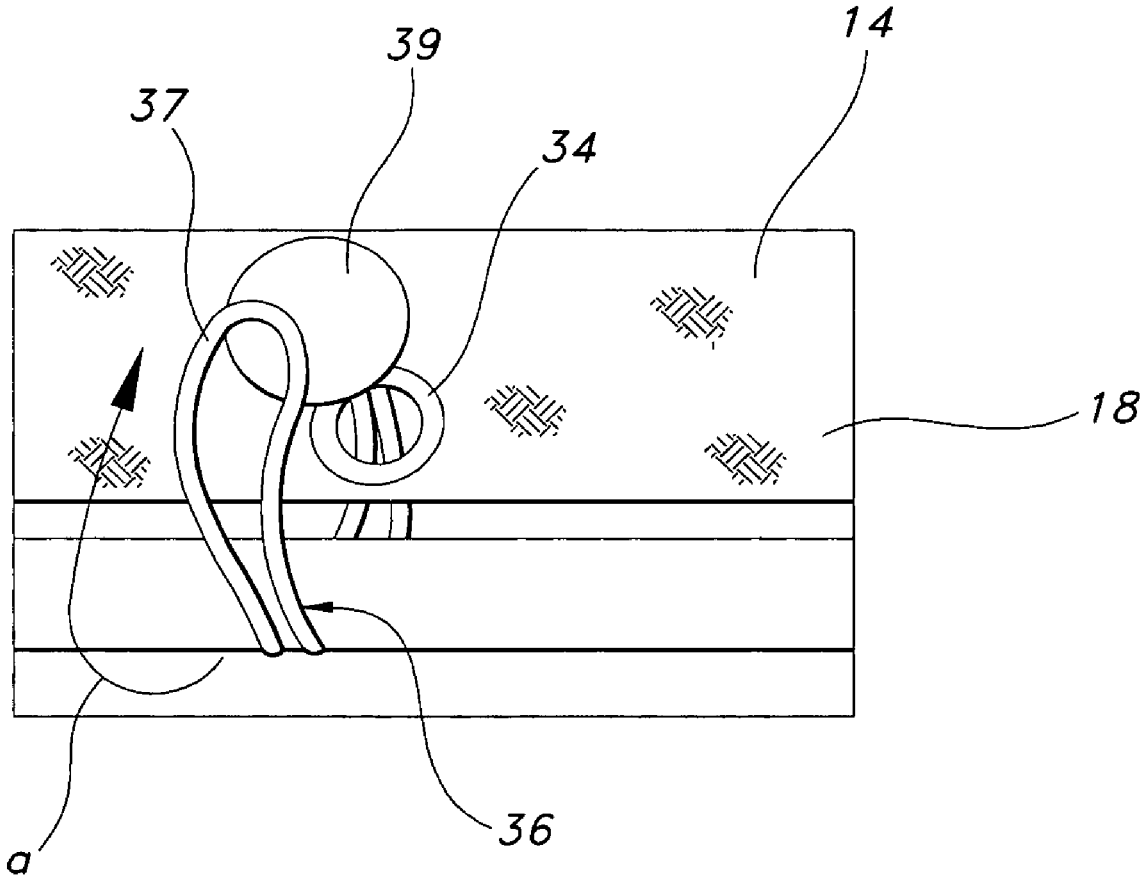
FIG. 4 is a detailed view of a bungee-ball cord sashing the canopy to the side of the frame of FIG. 1.
Figure 5:
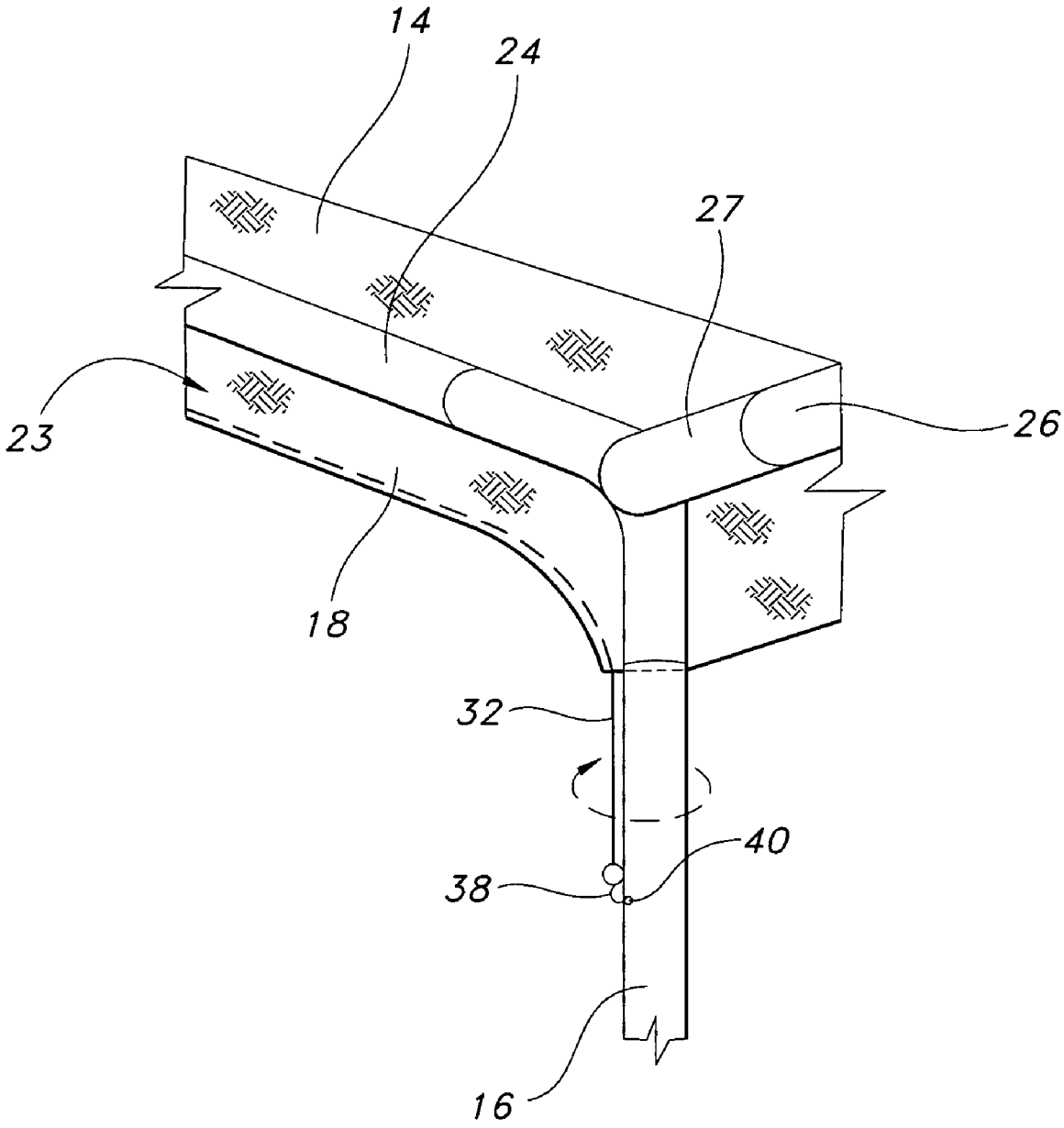
FIG. 5 is a detailed view of an upper corner of the frame of the shelter of FIG. 1 from the inside of the shelter prior to twisting the cord about the corner.
Figure 6:
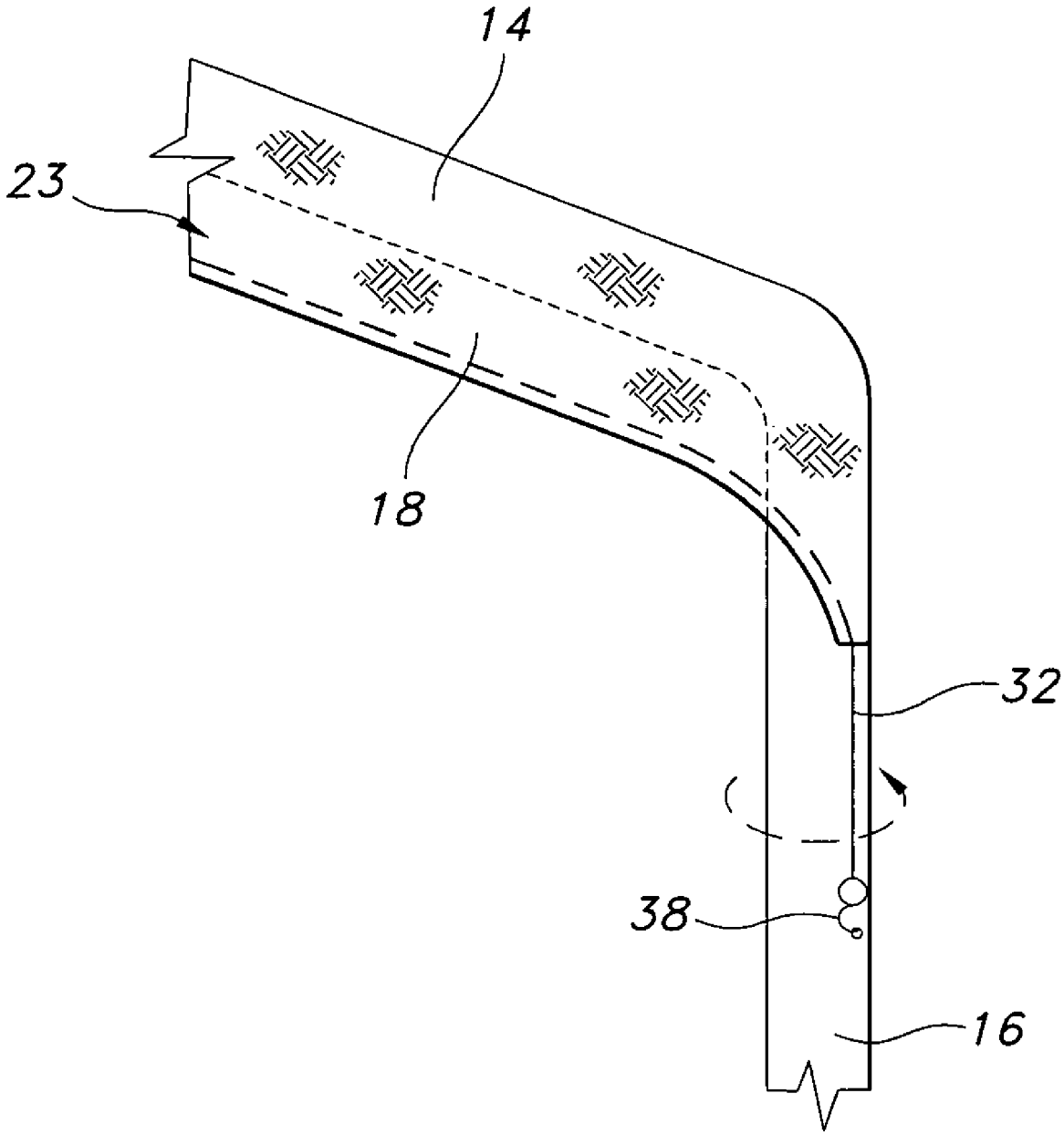
FIG. 6 is a detailed view of an upper corner of the frame of the shelter of FIG. 1 from the outside of the shelter prior to twisting the cord about the corner.
Figure 7:
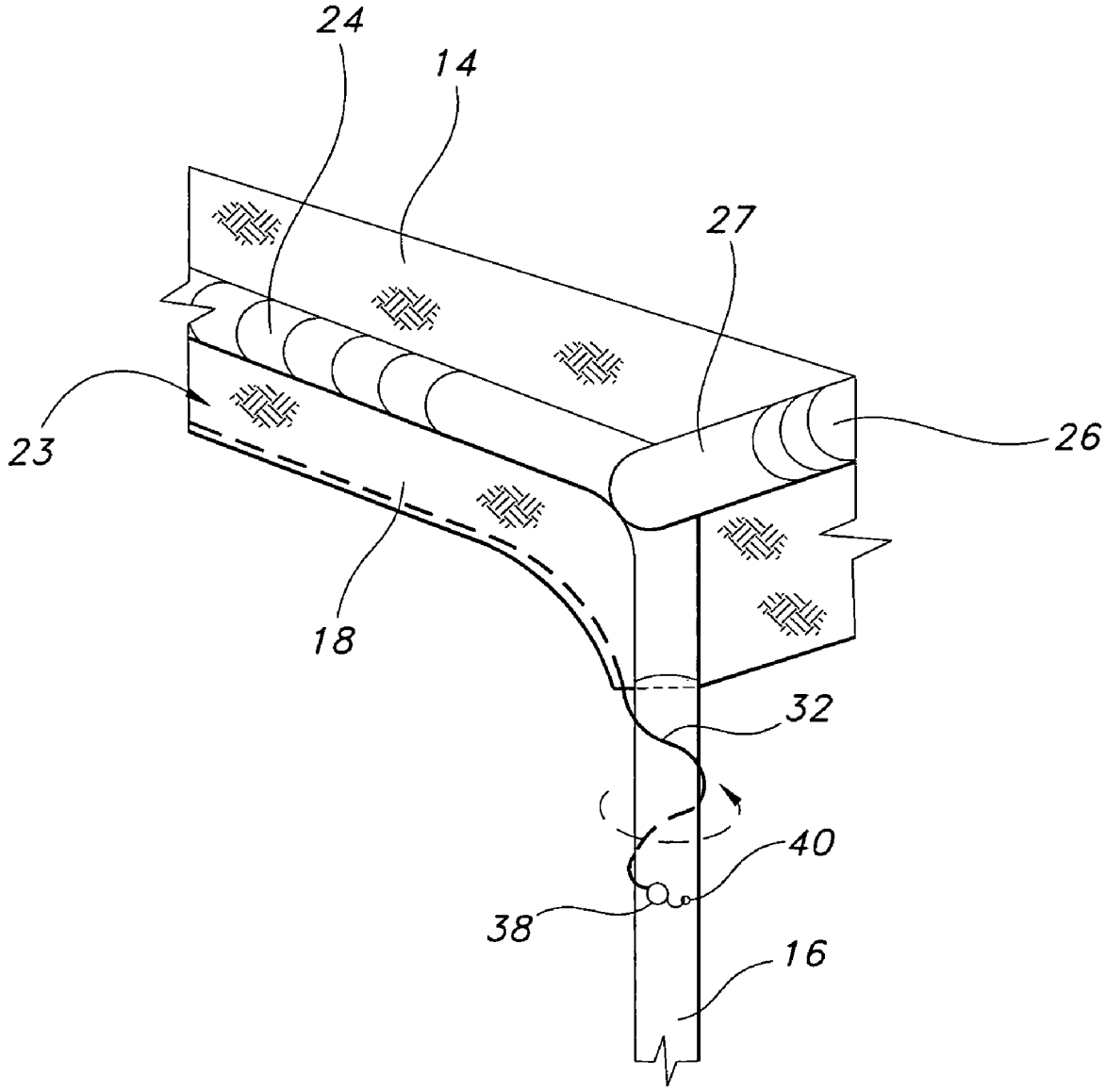
FIG. 7 is a detailed view of an upper corner of the frame of the shelter of FIG. 1 from the inside of the shelter after twisting the cord about the corner.
Figure 8:
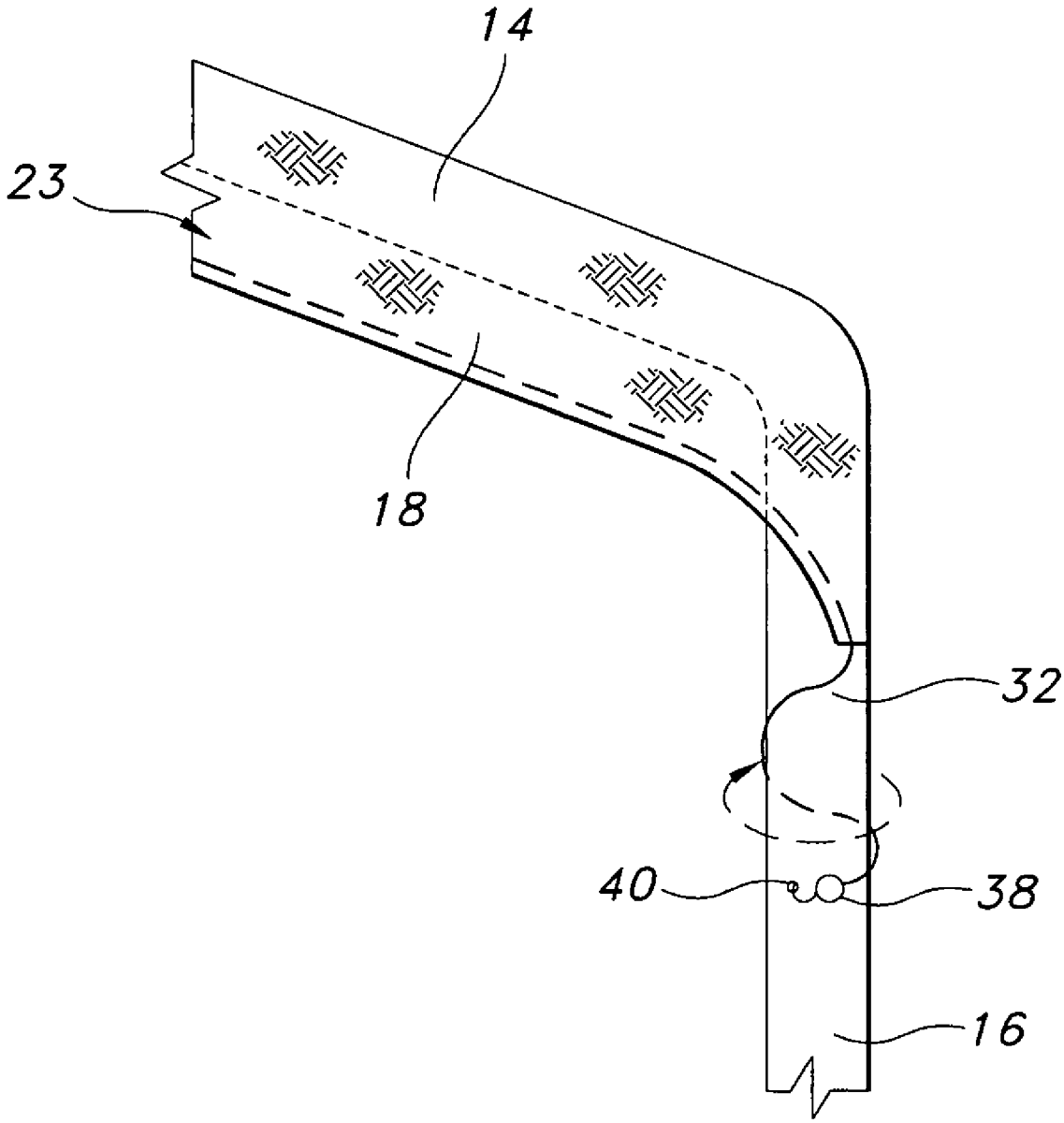
FIG. 8 is a detailed view of an upper corner of the frame of the shelter of FIG. 1 from the outside of the shelter after twisting the cord about the corner.

Referring to FIG. 1, a shelter 10 in accordance with the present disclosure includes a frame 12 with a canopy 14 mounted thereon. As shown, the shelter 10 is in a raised or "set-up" condition. Although the subject invention is discussed with respect to frame 12, it will be appreciated by those of ordinary skill in the pertinent art that many different configurations of frame would benefit from the subject disclosure. Preferably, the sides 18 of the canopy 14 are secured to the frame 12 by a plurality of bungees 36 as will be described below with respect to FIG. 4 and the front 20 and back 22 of the canopy 14 are secured to the frame 12 by cording 32 as will be described below with respect to FIGS. 5–9.

Figure 2:
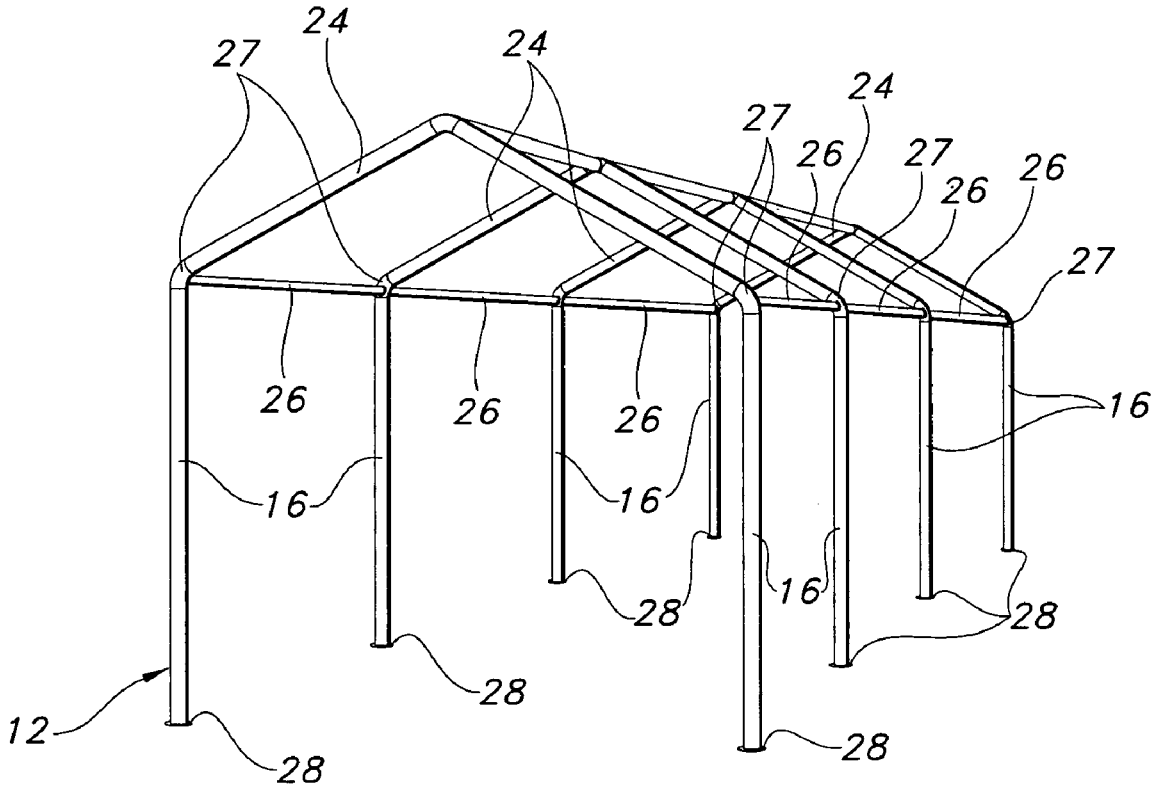
FIG. 2 is a perspective view of the frame of FIG. 1.
Figure 3:
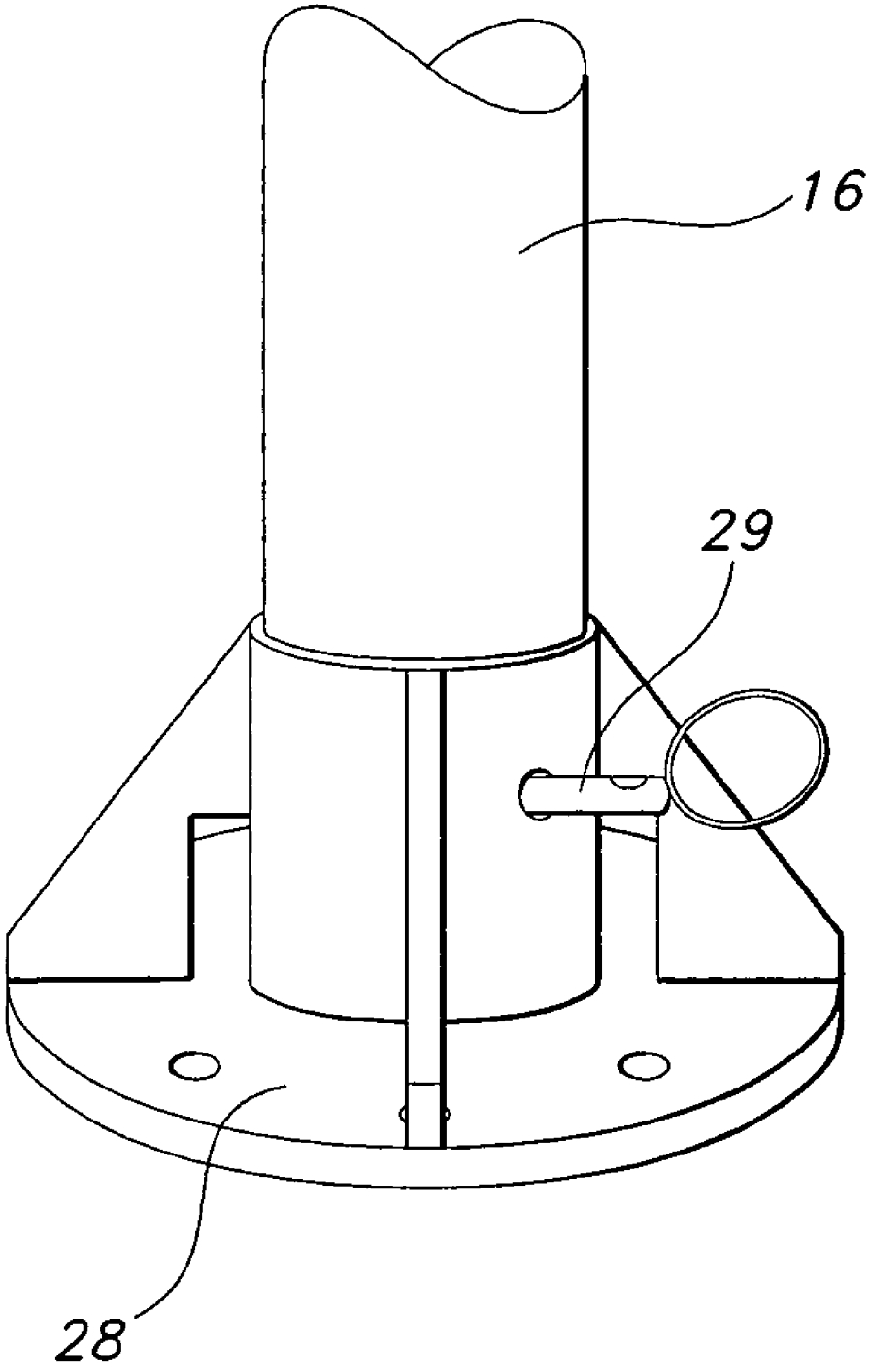
FIG. 3 is a detailed view of a foot plate for a leg of the frame of the shelter of FIG. 1.

Referring also to FIG. 2, the frame 12 includes eight legs 16 supporting by laterally extending trusses 24. It should be understood, however, that a frame 12 according to the present disclosure may include more or less than eight legs with corresponding trusses 24. It should be appreciated that all the legs 16 may be identical or varied in configuration. Substantially horizontal cross poles 26 extend between the legs 16. When assembled, the legs 16, trusses 24 and cross poles 26 are joined and linked together using a plurality of connectors 27. In a preferred embodiment, the legs 16, trusses 24, cross poles 26 and connectors 27 are PVC pipe. In alternative embodiments, the frame 12 is in the form of hollow tubes fabricated from a metal such as an aluminum allow, a suitably strong plastic polymer or combinations thereof. Preferably, the legs 16 are supported at the ground level by optional feet plates 28 (best seen in FIG. 3) which are secured thereto by a fastener 29. Further, it will be appreciated that the frame 12 may be set in concrete or partially buried to further stabilize the shelter 10.

The canopy 14 of the shelter 10 is preferably a resilient, weather-proof material such as water sealed nylon and the like to preferably provide sufficient protection from the elements. In a preferred embodiment, the canopy 14 is made from a substantially rectangular piece of material slightly larger than the footprint of the shelter 10. It should be appreciated that the material may be sewn, welded and the like to create pockets or sleeves 23 and secure features thereto. In a preferred embodiment, the canopy 14 is folded back, stitched and welded so as to effectively form sleeves 23 along the front 20 and back 22 of the canopy 14. Disposed within the sleeves 23 is cording 32, which is preferably rope although the cording 32 may be elastic as well.

The canopy 14 is also folded back and welded along the sides 18 to double the material. In this case, the doubling back of material is intended to provide additional strength to the sides 18 such that each side 18 may accommodate a plurality of reinforcing grommets 34. The reinforcing grommets 34 are typically formed of metal and are press fit into apertures formed in the sides 18 of the canopy 14 so as to provide a high strength, rip resistant attachment point for cords 36.

Referring to FIGS. 1–4, to assemble the shelter 10, the canopy 14 is placed upon the assembled frame 12. A plurality of bungee-ball cords 36 are fed through the grommets 34 and around the crosspoles 26 along arrow "a" for lashing the sides 18 of the canopy 14 to the frame 12. Preferably, the elastic portion 37 of the bungee-ball cords 36 forms a loop which hooks onto the ball 39 for a tight secure fit of the canopy 14 which can withstand windy conditions. Although the ball 39 is shown larger that the aperture formed by the grommets 34, a variety of sashing mechanisms could be advantageously employed as would be appreciated by those of ordinary skill in the pertinent art.

Turning to FIGS. 5–8, with the canopy 14 partially secured on the sides 18 by the bungee-ball cords 36, the cording 32 secures the canopy to the frame 12 by attaching to the corner legs 16, respectively. Hooks 38 are attached to the ends of the cording 32 which has been fed through the sleeves 23 of the front 20 and back 22 of the canopy 14. It should be appreciated that the cording may be elastic, traditional rope and the like and the hooks 38 although shown as S-shaped may be of a variety of suitable configurations well known to those skilled in the pertinent art. The hooks 38 secure the cording 32 to the corner legs 16 by engaging a hole 40 formed in each of the corner legs 16. In another embodiment, the cording 32 is pulled tight and secured to the corner legs 116 to tension the canopy 14 not only in the front and back but on the sides as well.

In a preferred embodiment, upon engagement of the hooks 38 in the holes 40, each corner leg 16 is twisted with respect to the respective connector 27 to increase the tension on the cording 32 and, in turn, increase the tension on the front 20 and back 22 as well as the sides 18 which are also tensioned about the corner legs 116. As a result of the twisting, the canopy 14 has an improved tight fit which looks pleasing and can withstand the elements. The size and configuration of the canopy 14 as shown is particularly well-suited to completely tensioning without puckering. In another embodiment, additional pockets, having the cording 32 therein, are created in the canopy 14 parallel to the crosspoles 26, and secured to the legs 16. Then, the legs 16 can be twisted to further tighten and secure the canopy 14.

Figure 9:
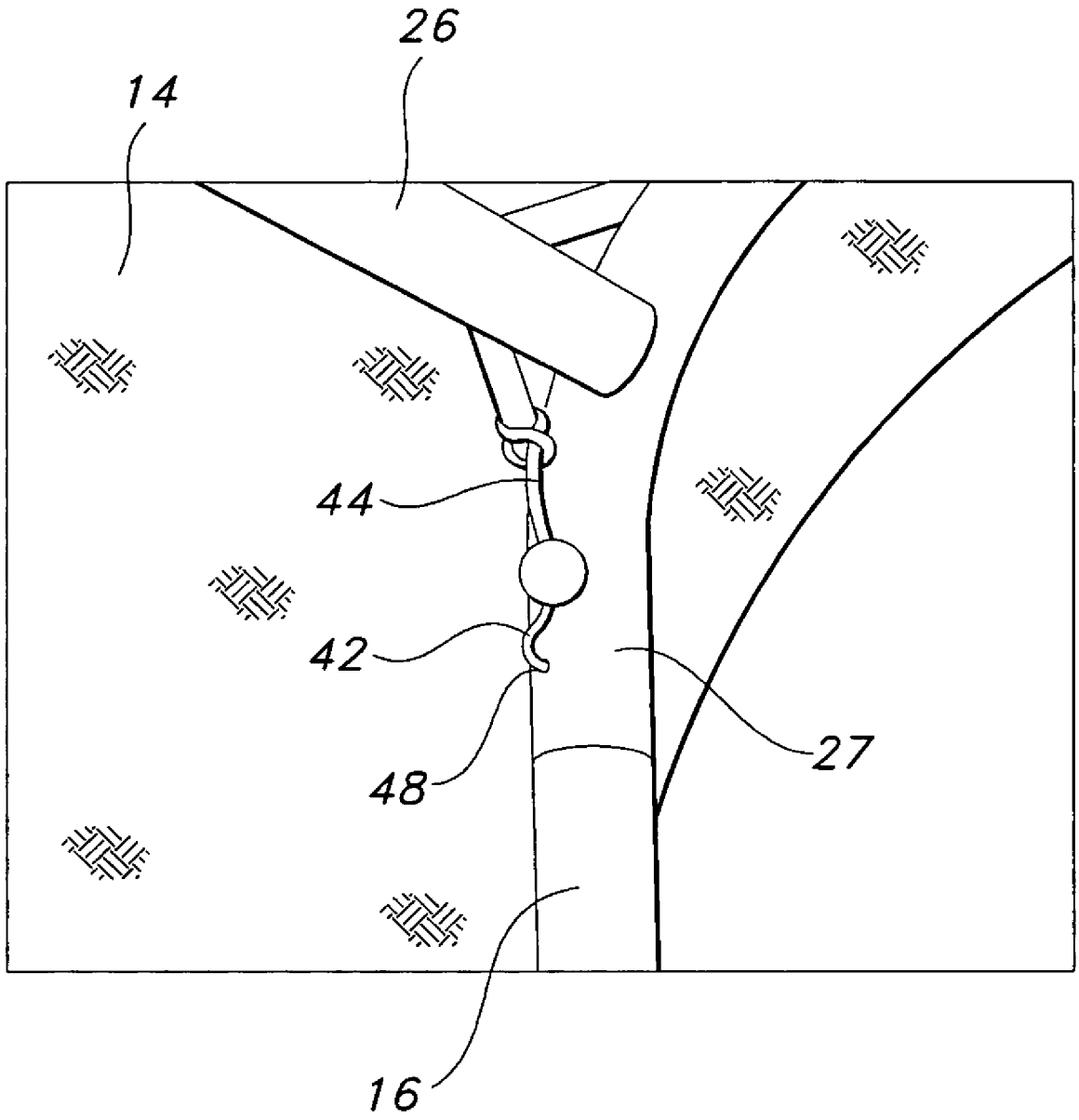
FIG. 9 is a detailed view of the assembly for maintaining rotational position of the corner of the shelter of FIG. 1.

Referring now to FIG. 9, to prevent the corner legs 16 from unraveling and releasing the tension from twisting, a retaining hook 42 can engage a hole 48 in the coupling 27 depending from the truss 24 and a hole (not shown) in the upper portion of the corner legs 16 to fix the rotational position thereof. A bungee-ball assembly 44 secures the hook 42 in place to prevent the hook 42 from wobbling loose in high wind conditions. It is envisioned that multiple holes may be formed in the couplings 27 or the corner legs 16 to allow a series of adjustment points and to allow for subsequent tightening as required. In another embodiment (not shown), a depressible button on the top portion of the legs 16 selectively engages one of a plurality of holes in the couplings 27 to secure the rotational positions of the legs 16.

Figure 10:
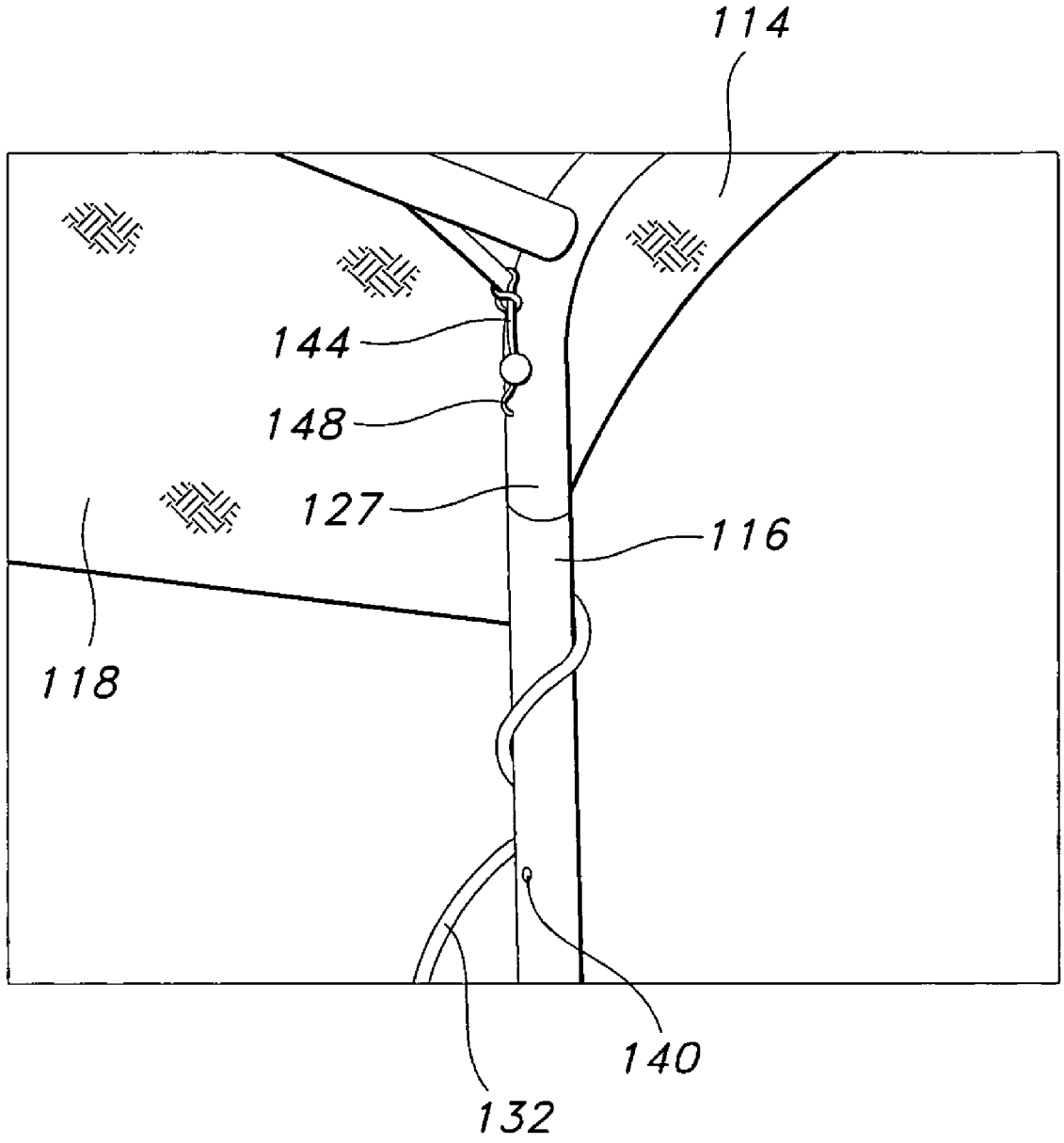
FIG. 10 is a detailed view of an upper corner of the frame of the shelter of a second embodiment from the inside of the shelter prior to fixing the cord about the corner.
Figure 11:
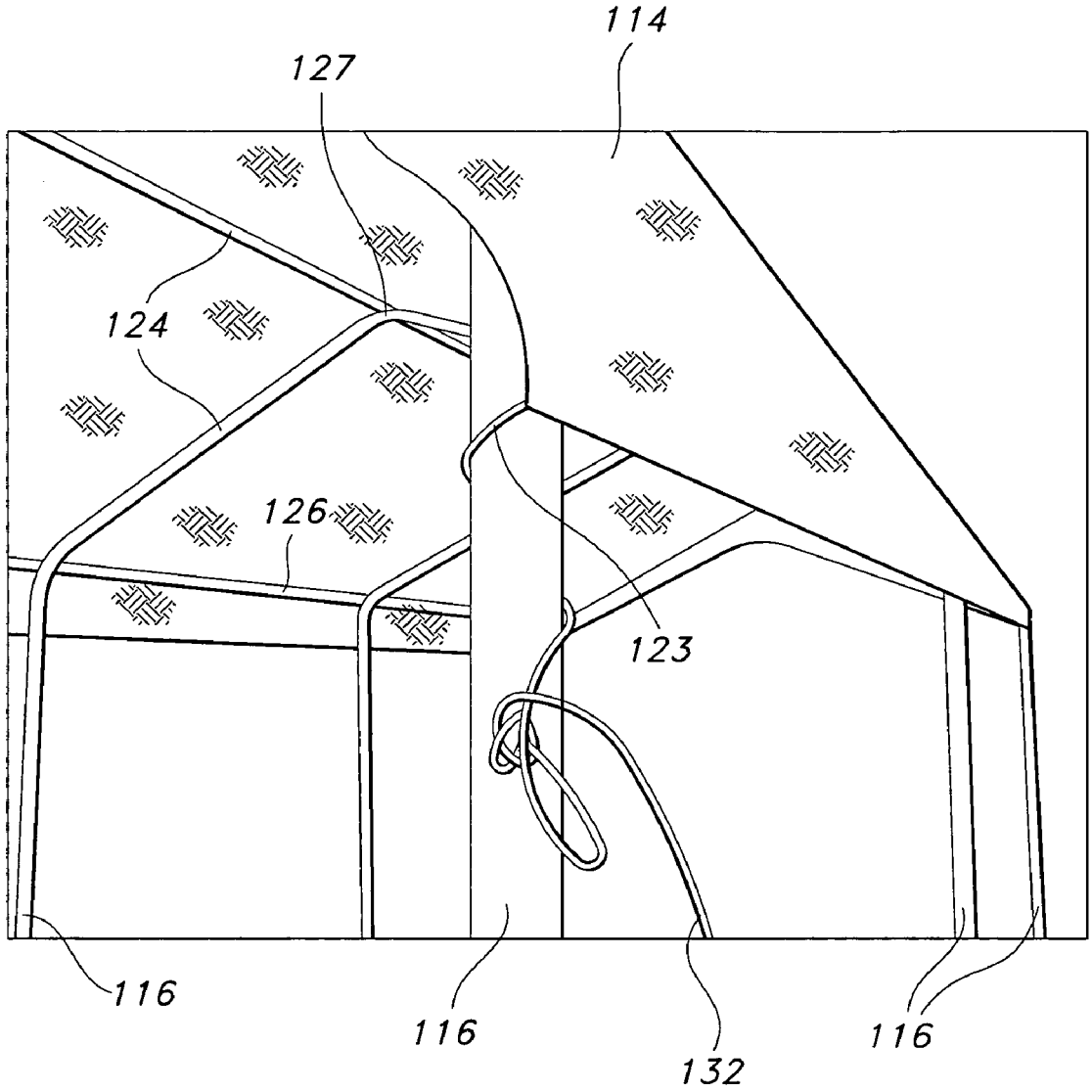
FIG. 11 is a detailed view of an upper corner of the frame of the shelter of FIG. 10 after fixing the cord about the corner.

Referring to FIGS. 10 and 11, in another embodiment, an alternative twist tensioning arrangement for a shelter 110 is shown. As will be appreciated by those of ordinary skill in the pertinent art, the shelter 110 is only partially illustrated and utilizes the same principles of the shelter 10 described above. Accordingly, like reference numerals preceded by the numeral "1" are used to indicate like elements. The cording 132 does not have a hook but simply threads into a through hole 140 in the corner legs 116. As the cording 132 is pulled taught, the respective front or back and corresponding side are tensioned onto the frame 112. Upon tensioning, the cording 132 is tied to the corner leg 116 prior to twisting the leg 116 to complete the tensioning operation. Alternatively, the cording 132 is wrapped around the leg 116 to tension the canopy 114 onto the frame 112 then secured in through hole 140. In still another embodiment, the cording 132 is simply pulled tight and tied, hooked or otherwise fastened to the frame 112.

While the invention has been described with respect to preferred embodiments, those skilled in the art will readily appreciate that various changes and/or modifications can be made to the invention without departing from the spirit or scope of the invention.

What is claimed is:

1. A method for assembling a shelter for providing protection comprising the steps of:

assembling a frame having opposing sides, a front, a back and a roof forming at least two pockets along opposing edges of a canopy;

disposing a cord in each of the pockets;

covering the roof with the canopy;

securing each end of the cords to a corner of the frame, each corner including an upstanding leg; and twisting at least one upstanding leg of the corners of the frame to tension the canopy onto the frame.

2. A method for assembling a shelter as recited in claim 1, wherein the cording is elastic.

3. A method for assembling a shelter as recited in claim 1, further comprising the step of sashing the canopy to the frame intermediate the at least two pockets.

4. A method for assembling a shelter as recited in claim 1, further comprising the step of preventing unraveling of the twisting of the corners of the frame.

5. A shelter for providing protection from weather elements comprising:

a frame having opposing sides, a front, a back and a roof wherein the roof is supported by legs sized and configured to rotate with respect to the roof between a first position and a second position;

a canopy covering the roof having two pockets formed along opposing edges thereof and a cord disposed in each of the pockets, each end of the cords being secured to a respective corner leg of the frame and the corner legs of the frame are rotated from the first to the second position, the canopy is tensioned onto the frame by the cords wrapping around the respective corner leg during rotating the corner legs from the first position to the second position.

6. A shelter as recited in claim 5, further comprising a plurality of foot plates for stabilizing the legs of the frame.

7. A shelter as recited in claim 5, further comprising a plurality of fastening assemblies sashing the canopy to the sides of the frame.

8. A shelter as recited in claim 5, further comprising a fastener received in a bore formed in the corner legs and roof to selectively maintain the second position of the respective corner leg.

9. A shelter as recited in claim 5, wherein a plurality of bores are formed in the corner legs to allow selective adjustment of the second position.

10. A shelter as recited in claim 5, further comprising a hook for securing each end of the cord to a hole formed in the respective corner leg.

11. A shelter as recited in claim 5, wherein the front of the frame is sized and configured to drive a vehicle therethrough.

12. A method for assembling a shelter for providing protection comprising the steps of:

assembling a frame having opposing sides, a front, a back and a roof, the frame including corner legs;

forming at least two pockets along opposing edges of a canopy;

disposing a cord in each of the pockets;

covering the roof with the canopy;

tightening the cords to tension the canopy onto the frame;

securing each end of the cords to a the respective corner of the frame; and twisting the respective corner legs to further tension the canopy onto the frame.

13. A method as recited in claim 12, wherein the cords are elastic.

14. A method as recited in claim 12, further comprising the step of preventing untwisting of the respective corner legs by implementing means for securing on the respective corner leg.

15. A method as recited in claim 14, wherein the means for securing is a fastener received in a bore formed in the corner legs and roof.

16. A method as recited in claim 15, wherein the means further includes a plurality of bores are formed in the corner legs to allow for selective adjustment of tensioning.

17. A method as recited in claim 14, placing the respective corner legs in a foot plate and using a fastener to secure the corner leg thereto, wherein the means for securing is the fastener.

* * * * *